US007932423B2

(12) United States Patent
Shepherd et al.

(10) Patent No.: US 7,932,423 B2
(45) Date of Patent: Apr. 26, 2011

(54) REMOVAL OF INERTS FROM NATURAL GAS USING HYDRATE FORMATION

(75) Inventors: Samuel L. Shepherd, Kingwood, TX (US); Eric Prim, Odessa, TX (US)

(73) Assignee: Pilot Energy Solutions, LLC, Houston, TX (US)

( * ) Notice: Subject to any disclaimer, the term of this patent is extended or adjusted under 35 U.S.C. 154(b) by 1353 days.

(21) Appl. No.: 11/423,639

(22) Filed: Jun. 12, 2006

(65) Prior Publication Data

US 2007/0106101 A1 May 10, 2007

Related U.S. Application Data

(60) Provisional application No. 60/733,926, filed on Nov. 7, 2005.

(51) Int. Cl.
*C07C 7/00* (2006.01)

(52) U.S. Cl. ..... 585/15; 585/833; 95/199

(58) Field of Classification Search ..... None
See application file for complete search history.

(56) References Cited

U.S. PATENT DOCUMENTS

| | | | | |
|---|---|---|---|---|
| 5,540,190 | A | 7/1996 | Rogers | |
| 5,613,362 | A | 3/1997 | Dixon | |
| 6,214,175 | B1 | 4/2001 | Heinemann | |
| 6,631,626 | B1 | 10/2003 | Hahn | |
| 7,255,794 | B2 | 8/2007 | Max | |
| 2004/0074389 | A1 * | 4/2004 | Jackson et al. | 95/153 |
| 2005/0005615 | A1 | 1/2005 | Runbalk | |

OTHER PUBLICATIONS

Holloman Corporation; PCT International Search Report; International Application No. PCT/US06/43425; International Filing Date: Nov. 6, 2006; Mailing Date; Jul. 16, 2007; 2 pgs.

Holloman Corporation; PCT Written Opinion of the International Searching Authority; International Application No. PCT/US06/43425; International Filing Date; Nov. 6, 2006; Mailing Date: Jul. 16, 2007; 3 pgs.

Osegovic, John P. et al; "Hydrate Gas Separation—A New Technology for Removing Nitrogen from Natural Gas" (Abstract Only); MDS Research, Oct. 2008; 1 pg.

Lee, Jong-Won, et al; "Phase behavior and structure transition of the mixed methane and nitrogen hydrates" (Abstract Only); Korean Journal of Chemical Engineering, 23(2), 2006; 1 pg.

Mei, Dong-Hai, et al; "Experimental and Modeling Studies on the Hydrate Formation of a Methane + Nitrogen Gas Mixture in the Presence of Aqueous Electrolyte Solutions" (Abstract Only); Industrial and Engineering Chemistry Research, 35(11), 1996; 1 pg.

U.S. Department of Energy, Office of Fossil Energy, CO2 Hydrate Process for Gas Separation From a Shifted Synthesis Gas Stream; (2 pages, Mar. 2004).

Nexant.com website printout (url http://www.nexant.com/services/AdvancedTech/clean-fossil/co2.html); Clean Fossil-CO2 Separation by Hydrate Formation (3 pages printed Dec. 12, 2006).

www.natcogroup.com website printout (url http://www.natcogroup.com/content.asp?t=ProductPage&ProductID=22), LTX Hydrocarbon Liquids Recovery (Issue1, Jul. 2002, pp. 571-A1 and 571-A2 printed Dec. 12, 2006).

Halliburton Gulf of Mexico Hydrates R&D Workshop Proceedings, Aug. 2000 (pp. 64-68).

* cited by examiner

*Primary Examiner* — Tam M Nguyen
(74) *Attorney, Agent, or Firm* — Conley Rose, P.C.; Grant Rodolph

(57) ABSTRACT

A method for separating a gas stream comprising methane and a contaminate gas comprises the steps of contacting the gas stream with water under temperature and pressure suitable for the formation of methane hydrates so as to form a water/hydrate slurry, separating the contaminate gas from the water/hydrate slurry, and recovering methane from the water/hydrate slurry so as to generate a water stream.

6 Claims, 3 Drawing Sheets

REMOVAL OF INERTS FROM NATURAL GAS USING HYDRATE FORMATION

CROSS-REFERENCE TO RELATED APPLICATIONS

This application claims priority to U.S. provisional application Ser. No. 60/733,926, filed on Nov. 7, 2005, which is entitled "Method of purifying natural gas streams," and is incorporated herein by reference,

STATEMENT REGARDING FEDERALLY SPONSORED RESEARCH OR DEVELOPMENT

Not Applicable.

FIELD OF THE INVENTION

The present invention relates generally to the removal of inert gases from natural gas by treating the gas in a methane hydrate formation system. Further processing includes reconstitution of the methane from the hydrate slurry.

BACKGROUND OF THE INVENTION

Natural gas occurs naturally in underground fossil fuel deposits or formations. Some formations contain relatively few hydrocarbons that are liquid at ambient temperatures. When produced, such as via a drilled well, these formations produce natural gas and are termed "gas wells," in contrast to wells that produce primarily liquid hydrocarbons. As-produced, natural gas is typically a mixture of methane (single carbon, formula $CH_4$) with varying concentrations of other gases, which may include $C_{2+}$ hydrocarbons, carbon dioxide, and inert gases such as nitrogen. By way of example, Table 1 below gives exemplary ranges for the proportion of several components that may be present in produced natural gas. Table 1 also includes the proportion of each component that typically must be present in commercial grade gas, i.e. gas that is worth processing and shipping. Notably, nitrogen and carbon dioxide can each occur naturally at levels well above the commercially acceptable range. In such cases, it is necessary to treat the produced natural gas.

TABLE 1

| Component | Naturally Occurring Range (mole %) | Commercial Range (mole %) |
|---|---|---|
| Methane | 25-100 | >70 |
| Ethane | 0-20 | 0-20 |
| Propane | | |
| Butane (iso-, normal-) | | |
| Pentane (iso-, normal-) | trace-0.14 | — |
| Hexanes plus | trace-0.06 | — |
| Nitrogen | 0-50 | <4 |
| Carbon Dioxide | 0-60 | <1.0 |
| Oxygen | 0-0.2 | <0.1 |
| Hydrogen | | <0.02 |
| Hydrogen sulphide | 0-5 | — |
| Rare gases (A, He, Ne, Xe) | trace | — |

Whether a given gas well, non conventional biogas generator, or syngas facility is worth producing or operating depends on the relative amounts of the hydrocarbons, which are valuable as fuels, and other gases, which have little or no value. Nitrogen and carbon dioxide are inert gases with no BTU value. If low-value gases are present at high levels in a produced gas stream, their concentration must be reduced to low levels (typically <4% for nitrogen) before the gas can be sold.

At present, many gas wells are shut in, i.e. capped and non-producing, because the mixture of gases they produce contains too few hydrocarbons to justify the cost of production and separation. It has been estimated that much as 15% of the United States' natural gas reserves contain too much nitrogen to be shipped as-is.

U.S Pat. No. 6,444,012 provides a good description of various methods that have been used to remove or reduce the concentration of nitrogen in natural gas. Despite the advances that have been made in this area, however, current technologies for separating the hydrocarbons from the other gases remain less than satisfactory. Hence, it is desirable to provide a system in which methane and $C_{2+}$ hydrocarbons can be inexpensively and effectively separated from other gases that may be present in a produced natural gas stream.

SUMMARY OF THE INVENTION

The present invention provides a method and apparatus that allow an inexpensive and effective separation of methane and $C_{2+}$ hydrocarbons from other gases that may be present in a produced natural gas stream. According to preferred embodiments, a produced natural gas stream is contacted with chilled water, with or without the addition of hydrophilic organic or inorganic molecules under temperature and pressure conditions that are conducive to the formation of hydrates. Once the methane is captured in an aqueous hydrate slurry, the inert gases, which do not form hydrates at equivalent kinetic rates, can be vented or captured. The hydrate slurry can then be subjected to conditions that cause the methane to be released from the hydrates, whereupon it can be recovered.

Thus, the present invention comprises a combination of features and advantages that enable it to overcome various problems of prior devices. The various characteristics described above, as well as other features, will be readily apparent to those skilled in the art upon reading the following detailed description of the preferred embodiments of tile invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

Figure 1:
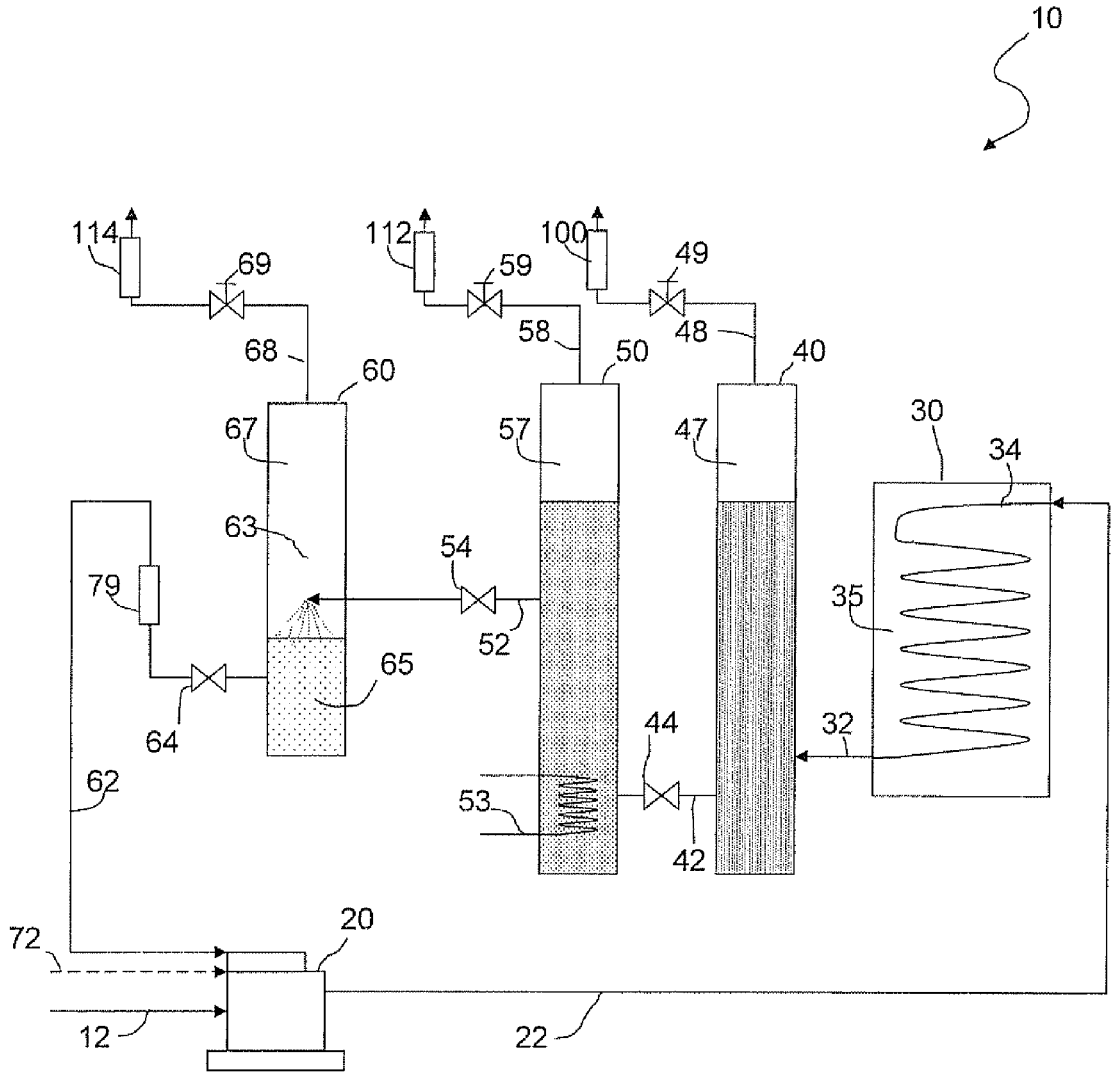
FIG. 1 is a schematic diagram of a system for removing nitrogen from methane according to a first embodiment of the invention.

Referring initially to FIG. 1 and according to a first embodiment of the invention, a system 10 for separating inerts, and nitrogen in particular, from a produced gas stream includes a pump 20, a chiller 30, a first separation tank 40, a second separation tank 50, and a third separation tank 60.

A gas feed line 12 flows into pump 20. A pressured gas/water line 22 leaves pump 20 and flows into chiller 30. A first hydrate line 32 leaves chiller 30 and flows into first separation tank 40. A second hydrate line 42 leaves first separation tank 40 and flows into second separation tank 50. A water line 52 leaves second separation tank 50 and flows into third separation tank 60. Finally, a water recycle line 62 leaves third separation tank 60 and flows into pump 20, along with gas feed line 12. In preferred embodiments, flow in second hydrate line 42 is controlled by a valve 44, flow in water line 52 is controlled by a valve 54, and flow in water recycle line 62 is controlled by a valve 64.

Figure 3:
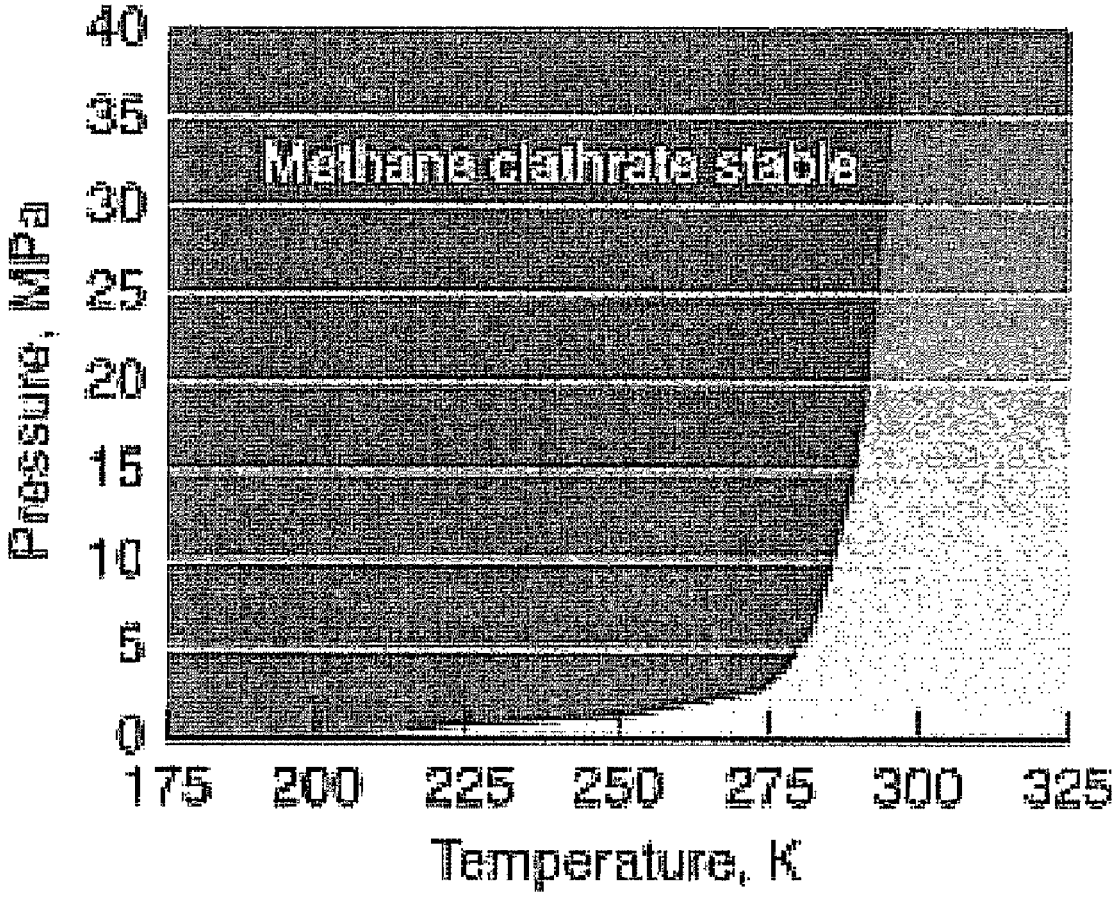
FIG. 3 is a plot showing the pressure and temperature conditions under which methane hydrates are stable.

Pump 20 can be any mechanical device capable of receiving a gas feed and a water feed via recycle line 62 or an outside water line 72 (shown in phantom) and increasing the pressure of the combined stream to at least about 10 atm (1.0 MPa) and preferably about 15 to 50 atm (1.5 to 5.0 MPa). The conditions at which methane clathrates are stable are shown in FIG. 3. Pumps that are suited for duty under these conditions are readily commercially available.

Chiller 30 preferably comprises a system for converting the combined pressurized stream into a water/hydrate slurry. In many applications, this will entail chilling the pressurized stream to a temperature below 57° F. (287 K) and in some embodiments to a temperature less than 44° F. (280 K), 35° F. (275 K), or more preferably less than 20° F. (266 K). In some embodiments, an organic or inorganic hydrophilic compound may be added to enhance hydrate formations. Because gas hydrates form only within relatively narrow temperature and pressure ranges, the pressure and temperature are maintained within a range that is suitable for the formation of hydrates. This range may depend on the nature of the gas being processed and can be affected by the type of additive. When the gas is natural gas, these ranges are 10-60 atm (1.0-6.0 MPa) and 28-80° F. (270-300 K), respectively Chiller 30 preferably includes a means for effectively removing heat from the pressurized gas/water stream. One suitable approach includes passing the gas/water stream through a coiled or looped line 34 immersed in a chilled water or brine bath or a refrigeration unit 35. The fluids within line 34 are effectively cooled to the temperature of bath 35, particularly if the bath is circulating and maintained at a steady temperature and the coil 34 is constructed of a material having high thermal conductivity. Those skilled in the art will recognize that alternative heat removal systems, such convective refrigeration systems can also be used. Reduction of the temperature of the gas/water stream, coupled with maintained high pressure results in the formation of gas hydrates. Gas/water stream 22 preferably includes excess water, so that the formation of hydrates results in formation of a pumpable or flowable slurry.

The water/hydrate slurry flows via line 32 into first separation tank 40, which preferably includes a headspace 47 and a gas bleed-off line 48 controlled by a valve 49. Tank 40 is preferably quiescent and is provided so that the gases that were not captured as hydrates (clathrates) in chiller 30 can be removed through simple gravity separation. The pressure and temperature in tank 40 are preferably maintained at conditions that do not cause the clathrates in the slurry to dissociate. In some embodiments, the temperature will be between about 0° C. and 25° C. and the pressure will be between about 300 psia and 1400 psia. Because nitrogen does not form hydrates and is relatively insoluble in water, it will readily separate from the slurry and collect in headspace 47, from which it can be removed via bleed-off line 48. If the concentration of hydrocarbons in stream 48 higher than is desired, stream 48 can be passed through a second sequential chiller (not shown). Alternatively, the hydrocarbons present in stream 48 can be burned as fuel to provide energy to warm second separation tank 50 as described below.

The water/hydrate slurry next flows via line 42 into second separation tank 50, which preferably includes a headspace 57 and a gas bleed-off line 58 controlled by a valve 59. Tank 50 is maintained at temperature and pressure conditions that are sufficiently different from the conditions in tank 40 to cause the hydrates in the slurry to dissociate. Hence, the temperature is higher and/or the pressure is lower in tank 50 than in tank 40. In some embodiments, the temperature will be between about 0° C. and 25° C. and the pressure will be between about 10 psia and 500 psia. In some embodiments, tank 50 may include a heating coil 53 or other suitable heat exchange equipment for increasing the temperature of the slurry. The gas resulting from dissociation of the hydrates collects in headspace 57, and can be removed via bleed-off line 58.

In some embodiments (not shown) heat may be exchanged between gas/water stream 22 and the slurry in tank 50. This helps remove heat from stream 22, thereby reducing the load in chiller 30, and restores heat to the slurry so as to facilitate recovery of the methane from the slurry, resulting in increased overall efficiency. Conversely, the gases removed can be depressurized and further utilized for heat removal of the incoming water/gas slurry.

The remaining water, which may contain dissolved $CO_2$, flows via line 52 into third separation tank 60, which preferably includes a headspace 67 and a gas bleed-off line 68 controlled by a valve 69. Tank 60 is preferably maintained at a lower pressure than tank 50, so as to reduce the solubility of the dissolved gases and allow them to be separated from the water. The water is preferably injected into tank 60 through a spray nozzle 63 to facilitate gas separation. Relatively gas-free water 65, preferably at ambient conditions, is collected in the bottom of tank 60 and can be recycled through the system via line 62. If desired, the system may include a flow meter 100, 112, 114 on each gas bleed-off line 48, 58, 69, respectively.

Figure 2:
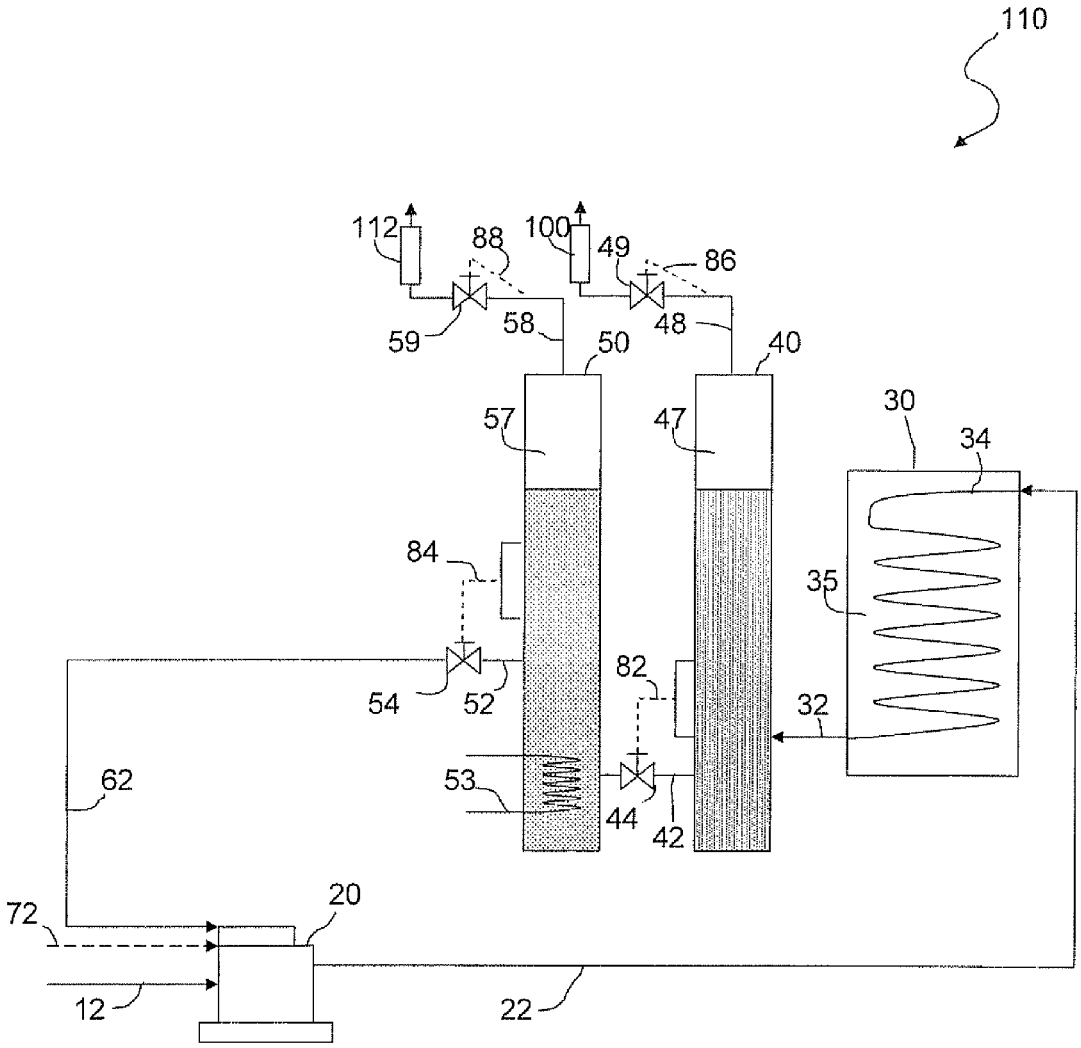
FIG. 2 is a schematic diagram of a system for removing nitrogen from methane according to a second embodiment of the invention.

In an alternative embodiment, shown in FIG. 2, $CO_2$ separation tank 60 is omitted. In this case, the water/slurry is saturated with $CO_2$, and additional $CO_2$ entering with feed stream 12 can be removed by other conventional means. If the stream is saturated with $CO_2$, all incoming $CO_2$ will exit with the natural gas Also as shown in FIG. 2, the system can include level controls 82, 84 and pressure controls 86, 88. Level controls 82, 84 control valves 44 and 52, respectively, while pressure controls 86, 88 control valves 49 and 59, respectively. It will be understood that these or similar controls could be used in the system shown in FIG. 1 and that controls systems in general are well known in the art. It will further be understood that each of the aforementioned process steps can be performed more than once, and that the presence or absence of a recycle or bypass line between one process step and another does not amount to a departure from the scope of the invention.

EXAMPLE

By way of example only, a typical feed stream may comprise 20% $N_2$, 5% $CO_2$, and the remainder hydrocarbons, with the hydrocarbons comprising substantially methane. For such a feed, the pressure in tank 40 may be approximately 41 atm (4.1 MPa) and the temperature may be 40° F. (278 K) or less, and the pressure in tank 50 may be approximately 20 atm (2.1 MPa) and the temperature may be 60° F. (290 K).

Flow rate for a producing well may be in the range of from a few barrels per day (bpd) to several hundred barrels per day. An exemplary methane clathrate hydrate composition may contain 1 mole of methane for every 5.75 moles of water. The density for hydrates having this composition is approximately 0.9 g/cm$^3$. Thus, one liter of methane clathrate solid can contain as many as 180 liters of methane gas (at STP).

Process control schemes for chilling, pressure reduction, and phase separation are well known to those having ordinary skill in the art and have not been shown in detail in this disclosure. Similarly, specific equipment sizing is well known to those having ordinary skill in tile art. Thus, for example, tank and flow line dimensions have not been spelled out both because sizing is well known in the art and because it is specific to a given application. It is intended that the following claims be interpreted to embrace all such variations and modifications.

While preferred embodiments of this invention have been shown and described, modifications thereof can be made by one skilled in the art without departing from the scope of this invention. For example, equipment other than what has been described can be substituted for the equipment mentioned herein. Accordingly, the scope of protection is not limited to the embodiments described herein, but is only limited by the claims which follow, the scope of which shall include all equivalents of the subject matter of the claims. Likewise, the sequential recitation of steps in the claim is not intended as a requirement that the steps be performed sequentially, or that one step be completed before commencement of another step. All processes described herein may be carried out as either batch or continuous processes, or as a combination of both.

What is claimed is:

1. A method comprising:

contacting a first natural gas stream with water, thereby forming a natural gas/water mixture, wherein the first natural gas stream comprises methane and a contaminant gas, and wherein the contaminant gas comprises carbon dioxide, nitrogen, or combinations thereof;

forming hydrates in the natural gas/water mixture, thereby forming a water/hydrate slurry;

separating at least some of the contaminate gas from the water/hydrate slurry at a first temperature of between about 0° C. and 25° C. and a first pressure of between about 300 psia and 1,400 psia; and recovering a second natural gas stream from the water/hydrate slurry, thereby generating a water stream.

2. The method of claim 1, wherein the second natural gas stream is recovered from the water/hydrate slurry at a second temperature of between about 0° C. and 25° C. and a second pressure of between about 10 psia and 500 psia.

3. The method of claim 1 further comprising removing an additional amount of the contaminant gas from the water stream subsequent to recovering the second natural gas stream.

4. The method of claim 3, wherein removing the additional amount of the contaminant gas produces a recycle stream, and wherein the water used to contact the first natural gas stream comprises the recycle stream.

5. The method of claim 3, wherein removing the additional amount of the contaminant gas occurs at an ambient temperature and an ambient pressure.

6. The method of claim 1, wherein forming hydrates in the natural gas/water mixture occurs at a temperature less than 57° F., wherein the first temperature is between about 0° C. and 25° C. and the first pressure is about 41 atm, and wherein the second temperature is 60 ° F. and the second pressure is about 20 atm.

* * * * *